US012345041B1

(12) United States Patent
St. Germain

(10) Patent No.: US 12,345,041 B1
(45) **Date of Patent: *Jul. 1, 2025**

(54) INTEGRATED JOINT SEALING SYSTEM

(71) Applicant: LOUISIANA-PACIFIC CORPORATION, Nashville, TN (US)

(72) Inventor: Brian St. Germain, Mt. Juliet, TN (US)

(73) Assignee: LOUISIANA-PACIFIC CORP., Nashville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/239,736

(22) Filed: Aug. 29, 2023

Related U.S. Application Data

(63) Continuation of application No. 17/182,634, filed on Feb. 23, 2021, now Pat. No. 11,739,522, which is a continuation of application No. 16/136,612, filed on Sep. 20, 2018, now Pat. No. 10,927,542.

(60) Provisional application No. 62/560,701, filed on Sep. 20, 2017.

(51) Int. Cl.

| | |
|---|---|
| ***E04B 1/68*** | (2006.01) |
| ***E04B 1/66*** | (2006.01) |
| ***E04B 2/00*** | (2006.01) |
| ***E04B 7/02*** | (2006.01) |
| ***E04D 3/36*** | (2006.01) |
| ***E04F 13/08*** | (2006.01) |
| *E04B 1/92* | (2006.01) |

(52) U.S. Cl.
CPC ..... *E04B 1/68* (2013.01); *E04B 1/665* (2013.01); *E04B 2/00* (2013.01); *E04B 7/02* (2013.01); *E04D 3/3602* (2013.01); *E04F 13/0889* (2013.01); *E04B 1/92* (2013.01); *E04F 13/0817* (2013.01)

(58) Field of Classification Search
CPC ... E04B 1/68; E04B 1/665; E04B 1/92; E04B 7/02; E04D 3/3602; E04F 13/0889; E04F 13/0817
See application file for complete search history.

(56) References Cited

U.S. PATENT DOCUMENTS

| | | | | |
|---|---|---|---|---|
| 2,702,412 | A * | 2/1955 | Asch | E04B 1/6104 52/275 |
| 6,293,069 | B1 * | 9/2001 | Monda | E04B 1/76 52/460 |
| 7,037,024 | B2 * | 5/2006 | Steinwender | E04F 15/04 403/267 |
| 7,155,871 | B1 * | 1/2007 | Stone | E04F 15/10 52/611 |

(Continued)

*Primary Examiner* — Adriana Figueroa
(74) *Attorney, Agent, or Firm* — Wayne Edward Ramage; Baker Donelson

(57) ABSTRACT

An integrated joint sealing system that is incorporated into the edges of a sheathing panel, which also may have a factory bonded weather resistive barrier. The edges of each panel are configured as a shiplap joint, or similarly functioning joint, that is present as either an overlap or underlap on each of the four panel edges. The arrangement of the joints are such that one edge will have an overlap and the opposite edge will have an underlap. A flexible gasket material (or materials) is factory applied to one or both sides (underlap and/or overlap) of the shiplap joint. This flexible gasket material, when overlapped with adjacent shiplap panels, provides a weather resistive seal to limit both water and air penetration.

15 Claims, 6 Drawing Sheets

(56) References Cited

U.S. PATENT DOCUMENTS

| | | | | |
|---|---|---|---|---|
| 7,677,002 | B2 * | 3/2010 | Bennett | B32B 21/14 52/177 |
| 7,721,506 | B2 * | 5/2010 | Bennett | E04D 3/351 52/177 |
| 8,726,604 | B2 * | 5/2014 | Hannig | E04F 15/02 52/592.1 |
| 8,789,329 | B2 * | 7/2014 | Radoane | E04B 2/88 52/746.1 |
| 9,382,713 | B2 * | 7/2016 | Bennett | E04D 3/35 |
| 9,422,727 | B2 * | 8/2016 | Sjoberg | E04F 15/02011 |
| 9,476,202 | B2 * | 10/2016 | Clancy | E04C 2/528 |
| 2004/0231252 | A1 * | 11/2004 | Benjamin | E04F 21/00 52/578 |
| 2017/0268232 | A1 * | 9/2017 | Renke | E04B 2/707 |

* cited by examiner

INTEGRATED JOINT SEALING SYSTEM

This application is a continuation of U.S. patent application Ser. No. 17/182,634, filed Feb. 23, 2021, which is a continuation of U.S. patent application Ser. No. 16/136,612, filed Sep. 20, 2018, which claims benefit of and priority to U.S. Provisional Application No. 62/560,701, filed Sep. 20, 2017, which are incorporated herein in their entireties by specific reference for all purposes.

FIELD OF INVENTION

This invention relates to an integrated joint sealing system for weather resistive barrier sheathing panels.

SUMMARY OF INVENTION

In various exemplary embodiments, the present invention comprises an integrated joint sealing system that is incorporated into the edges of a sheathing panel, which also may have a factory bonded weather resistive barrier. The integrated sealing system eliminates the need to secondarily apply tapes or similar fluid applied sealants as the joints will become sealed when mated and installed next to adjacent sheathing panels.

The invention utilizes a shiplap joint, or similarly functioning joint, that is present as either an overlap or underlap on each of the four panel edges. The arrangement of the joints are such that one edge will have an overlap and the opposite edge will have an underlap. This configuration applies to all edges of a panel. During installation, the panels are placed adjacent horizontally and/or vertically, with corresponding overlap edges and underlap edges of adjacent panels forming a full shiplap joint. This interlocking shiplap configuration repeats itself until the full wall area is covered.

In additional embodiments, a flexible gasket material is factory applied to one or both sides (underlap and/or overlap) of the shiplap joint. This flexible gasket material, when overlapped with adjacent shiplap panels, provides a weather resistive seal to limit both water and air penetration. As the gasket material is flexible, it will accommodate thickness and other variances likely in the wall assembly. Also, since the shiplap joint will provide ample overlap, any variance in sheathing panels not being aligned exactly with one another will also be accommodated. The gasket material may be applied to all surfaces of the shiplap joint: outside edge, horizontal surface, and inside edge. The gasket material may also be applied over the top face of the water/weather resistant barrier layer which corresponds to the fastener location for the purpose of sealing the fastener head against the face of the water/weather resistant barrier membrane.

DETAILED DESCRIPTION OF EXEMPLARY EMBODIMENTS

Figure 1:
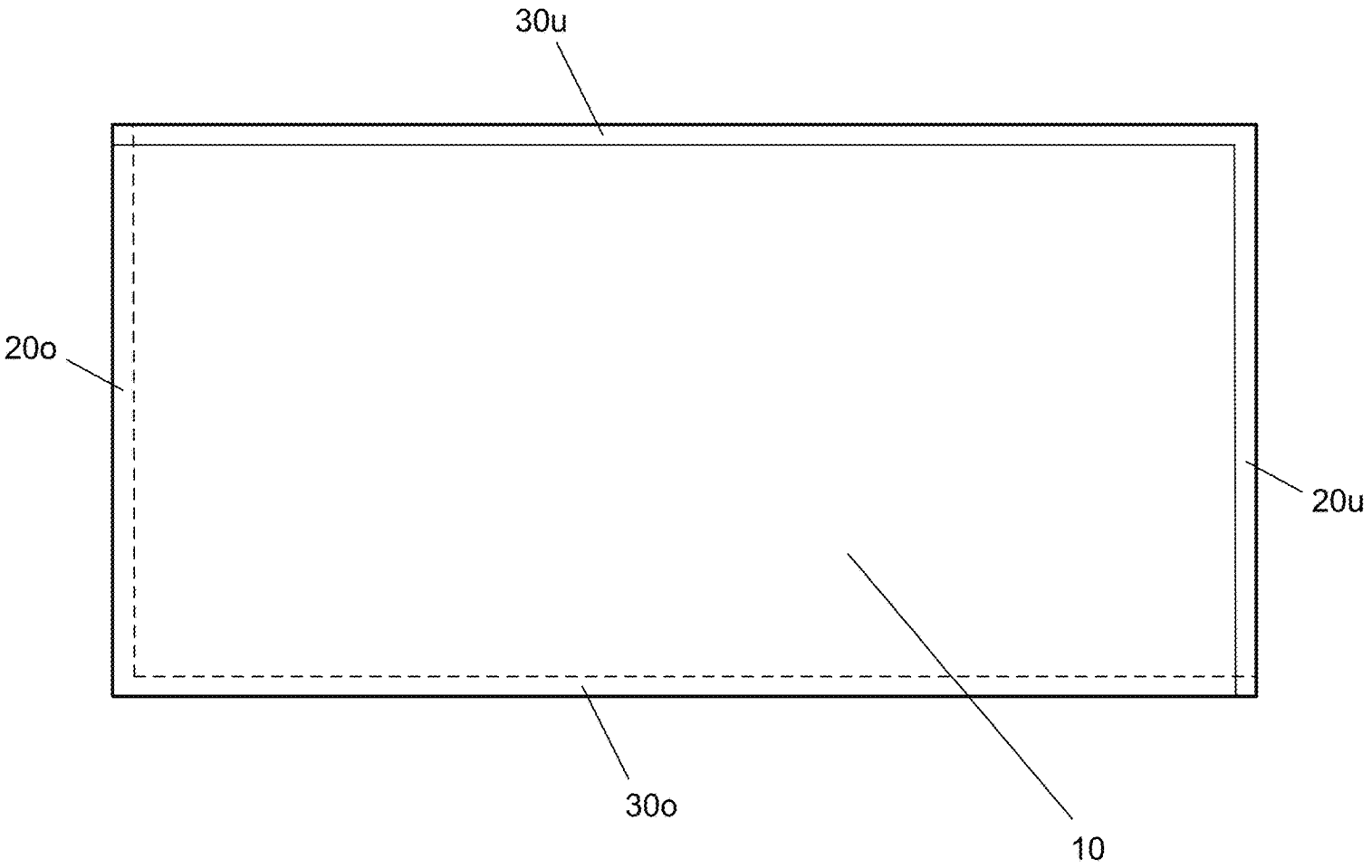
FIG. 1 shows a view of a panel in accordance with an exemplary embodiment of the present invention.

Wall and roof sheathing panels may consist of, but are not limited to, plywood, oriented-strand board (OSB), paper board, foam, gypsum, and glass mat. Sheathing panels typically are produced sizes of 4'×8', 4'×9', 4'×10' or similar dimensions. Wall sheathing is typically installed on the outside of a building's exterior envelope and may or may not be structural in design. Building codes typically require that a weather resistive barrier layer be applied to this sheathing layer prior to installation of exterior cladding. Weather resistive barriers have traditionally been applied on the jobsite following the installation of the wall sheathing. The weather resistive barrier membrane is typically sold in long rolls and fastened to the sheathing panels. The membrane will span multiple adjacent sheathing panels and is installed in a manner as to provide top over bottom and side overlaps to allow water to run from one layer to the next without entrapment (shingling). The membrane, once installed, is often left vulnerable to wind and weather which may cause damage to the membrane. Field-installed membranes also are difficult to properly air seal to meet building exterior air barrier requirements.

To address some of the problems of field-applied membranes, a new generation of products have been developed which have the weather resistive barrier membrane factory applied to the wall sheathing. These integrated products are fastened to the wall framing in a similar manner to the sheathing products listed above. In order to complete the system as a weather resistive barrier, the panel joints, both the short (typically 4') and long (typically 8', 9', or 10') must be sealed. The most common sealing method used currently consists of heavy flashing tapes that are applied so that the center of the tape width aligns with the center of the panel joint and therefore covers all nails used to fasten the sheathing along the panel edges. Other sealing systems include fluid applied coatings that may or may not use a reinforcing mesh. These coatings function similar to tape as they are applied to the center of the panel joint and extend over the panel edges to cover the nails used to fasten the sheathing to the wall framing.

Proper installation of the tape and/or fluid applied sealing systems is a critical step in the weather resistive barrier assembly, and time and care must be taken to ensure a durable, long lasting, sealed joint. As panel joints are lengthy it is often challenging for installers to ensure tape alignment and any corrections made during installation will typically result in a small fold in the tape which compromises the system. Proper adhesion of the tape or fluid sealant to the sheathing is another critical performance element and is often impacted negatively by dirt and moisture on the jobsite along with variable temperature and humidity. Many tapes used also require adequate pressure to bond the adhesives (pressure sensitive tapes), which can be challenging for installers that are often working above ground with limited mobility. All of these installation and product variances described necessitate the need for a more robust joint sealing mechanism.

In various exemplary embodiments, the present invention comprises an integrated joint sealing system that is incorporated into the edges of a sheathing panel, which also may have a factory bonded weather resistive barrier on one or more panel faces. The integrated sealing system eliminates the need to secondarily apply tapes or similar fluid applied sealants as the joints will become sealed when mated and installed next to adjacent sheathing panels.

The invention utilizes a shiplap joint, or similarly functioning joint, that is present as either an overlap or underlap (see FIG. 3) on each of the four panel edges. The arrangement of the joints are such that one edge will have an overlap and the opposite edge will have an underlap. In the joint, the overlap and underlap faces meet, and corresponding edge or end faces (at or near 90 degrees to the overlap and underlap faces) meet at one or both ends of the overlap/underlap.

Figure 2:
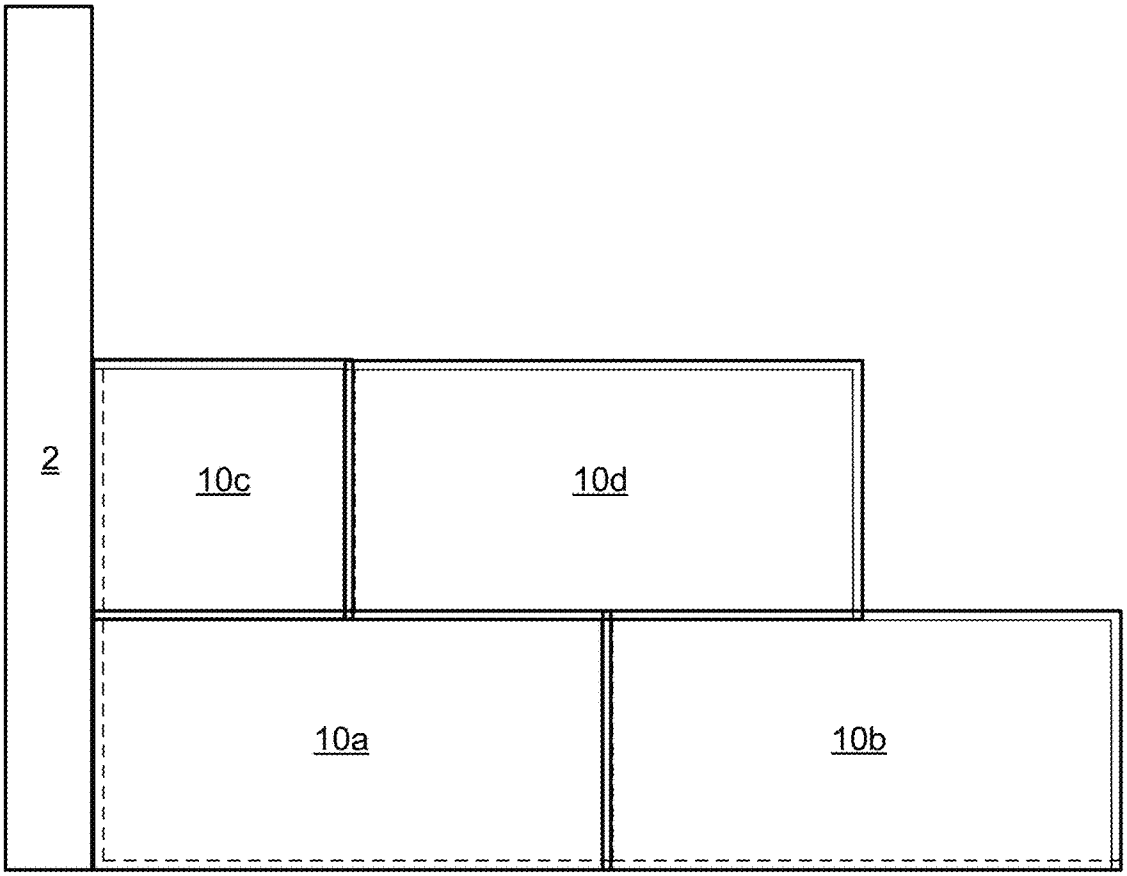
FIG. 2 shows a view of multiple panels being installed horizontally.

FIGS. 1 and 2 show an example of this configuration for a typical 4' wide by 8' long panel 10. One edge 20*o* along the narrow panel dimension (e.g., the 4' panel width) and an adjacent edge 30*o* along the long panel dimension (e.g., the 8' or longer panel length) are configured as an overlap portion of a shiplap joint (with FIG. 1 showing the top face view of the panel, the overlap portion is shown in broken lines), while the opposite edges 20*u*, 30*u* are configured as an underlap (shown in solid lines). In some embodiments, all edges are equal in length.

During installation, the first panel 10*a* installed may be on the side of the wall which allows the overlap panel edge (or underlap panel edge, in some installment configurations) to be nearest and flush to the wall framing so that the overlap joint of the next adjacent shiplap panel being installed 10*b* will cover the underlap of the first panel installed (or vice-versa). The shiplap configuration is such that the panels may be installed horizontally, with the long (8' or longer) panel dimension installed perpendicular to the vertical wall framing 2 (see FIG. 2). Subsequent panels, which may be shorter in length (e.g., 4' long and 4' wide) 10*c*, or longer (e.g., 8' long and 4' wide) 10*d*, may then be added in appropriate order. As shown, the panels in successive rows may be staggered so that panel corners where an overlap edge and a underlap edge meet (and thus may be thinner, weaker or milled-out entirely)

Figure 3:
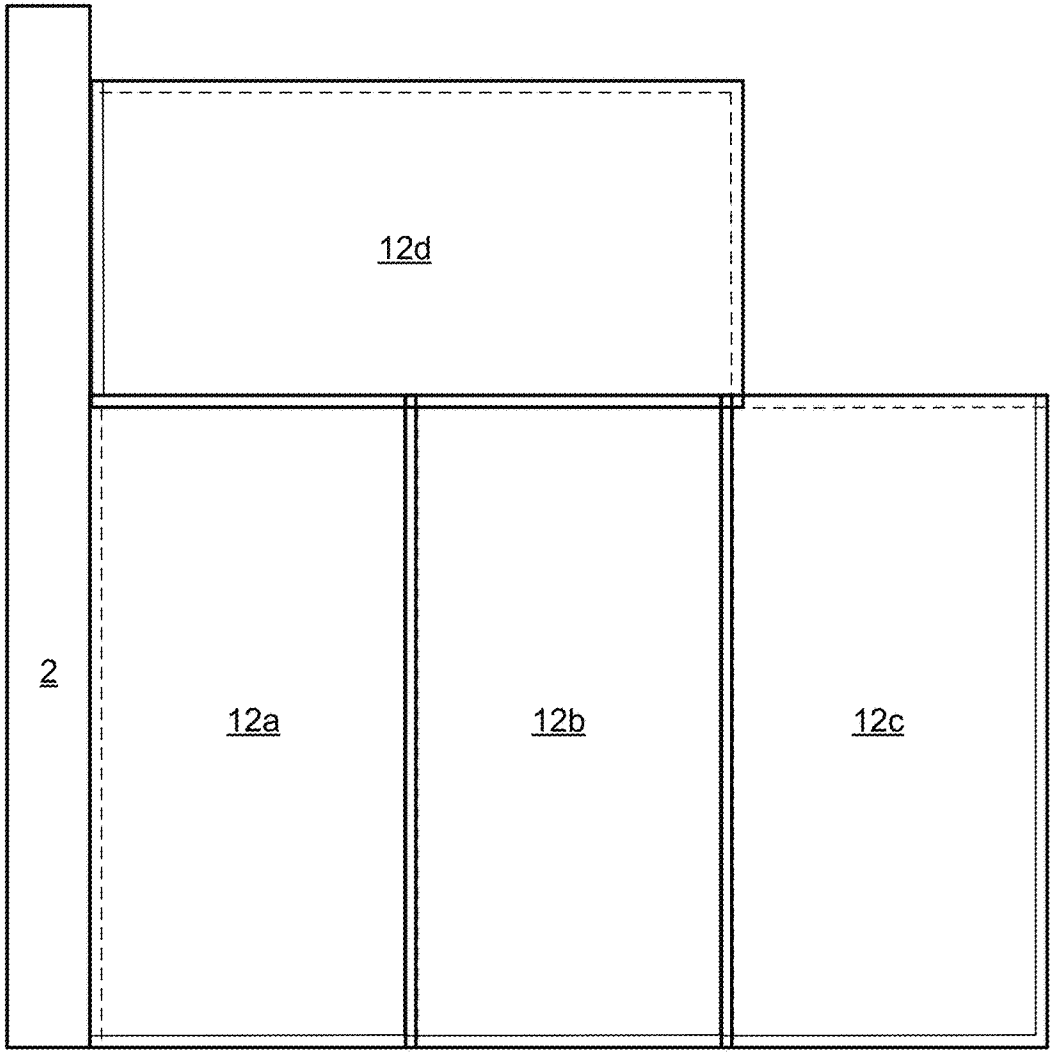
FIG. 3 shows a view of multiple panels being installed vertically.

Alternatively, the same panels may also be installed vertically 12*a-c*, with the long (8' or longer) panel dimension installed parallel to the vertical wall framing 2 (see FIG. 3). If a second horizontal row of panels are required the top edge of the first row would be the underlap side of the shiplap joint (or vice versa). The second row of panels would then have the overlap joint (or underlap, depending on the configuration of the first row) on the bottom which then overlaps onto the underlap of the first row of panels installed. In some embodiments, the first row (12*a-c*) is vertically oriented and the second row (12*d*) is horizontally oriented (or vice-versa). This interlocking shiplap configuration repeats itself until the full wall area is covered.

In several embodiments, a flexible gasket material (or materials) is factory applied to one or both face sides (underlap and/or overlap) of the shiplap joint, and/or one or both faces of the end or edge section of the joint. This flexible gasket material, when overlapped with adjacent shiplap panels, provides a weather resistive seal to limit both water and air penetration. As the gasket material is flexible, it accommodates thickness and other variances that are typical in the wall assembly. Also, since the shiplap joint provides ample overlap, any variance in sheathing panels not being aligned exactly with one another will also be accommodated. The gasket material (or materials) may be applied to all surfaces of the shiplap joint: outside edge/end, horizontal surface, and inside edge/end. The gasket material may also be applied over or under the top face of the water/weather resistant barrier (WRB) layer. In particular embodiment, the gasket material is applied to the area which corresponds to the fastener (e.g., nail) location, which seals the fastener head against the face of the WRB membrane when the fastener is installed.

In several embodiments, the gasket or sealing material may comprise a variety of components, including, but not limited to, rubber, silicone, polyurethane foam, urethane foam, and/or thermoplastic coatings (e.g., acrylics, polyvinyl acetates, polyvinyl esters, and the like). The same materials, or a combination of materials, may be applied to one or more surfaces of each joint assembly. Thus, for example, the same material can be applied to the overlap and underlap faces of the joint. Alternatively, one material can be applied to the overlap face and another material can be applied to the underlap face of the same joint, so that different materials are used on the same joint. Further, one material could be used on overlap and underlap faces (e.g., a foam), and another material (e.g., silicone) could be used on the edge or end faces of the joint.

FIG. 1 shows an example of the position of the shiplap overlap and underlap joints and how they are arranged on a rectilinear sheathing panel. FIG. 2 shows an example of how multiple panels may be installed in a horizontal orientation, with the initial panel first being installed on the lower, left side of the wall. This would allow for the underlap edges (or, in some installations, the overlap edges) of the panel to be flush to the wall framing. The next panel installed would be the right of the first panel with the overlap joint element of one panel mating up to the underlap joint element of the other panel. The next row of panels (above the one shown) would then have the overlap joint elements mating up to the underlap joint elements. This process would continue until the wall is covered.

FIG. 3 shows panels with the same shiplap configuration installed in a vertical orientation. The process to achieve the shiplap overlap/underlap would be the same as described for FIG. 1.

Figure 4:
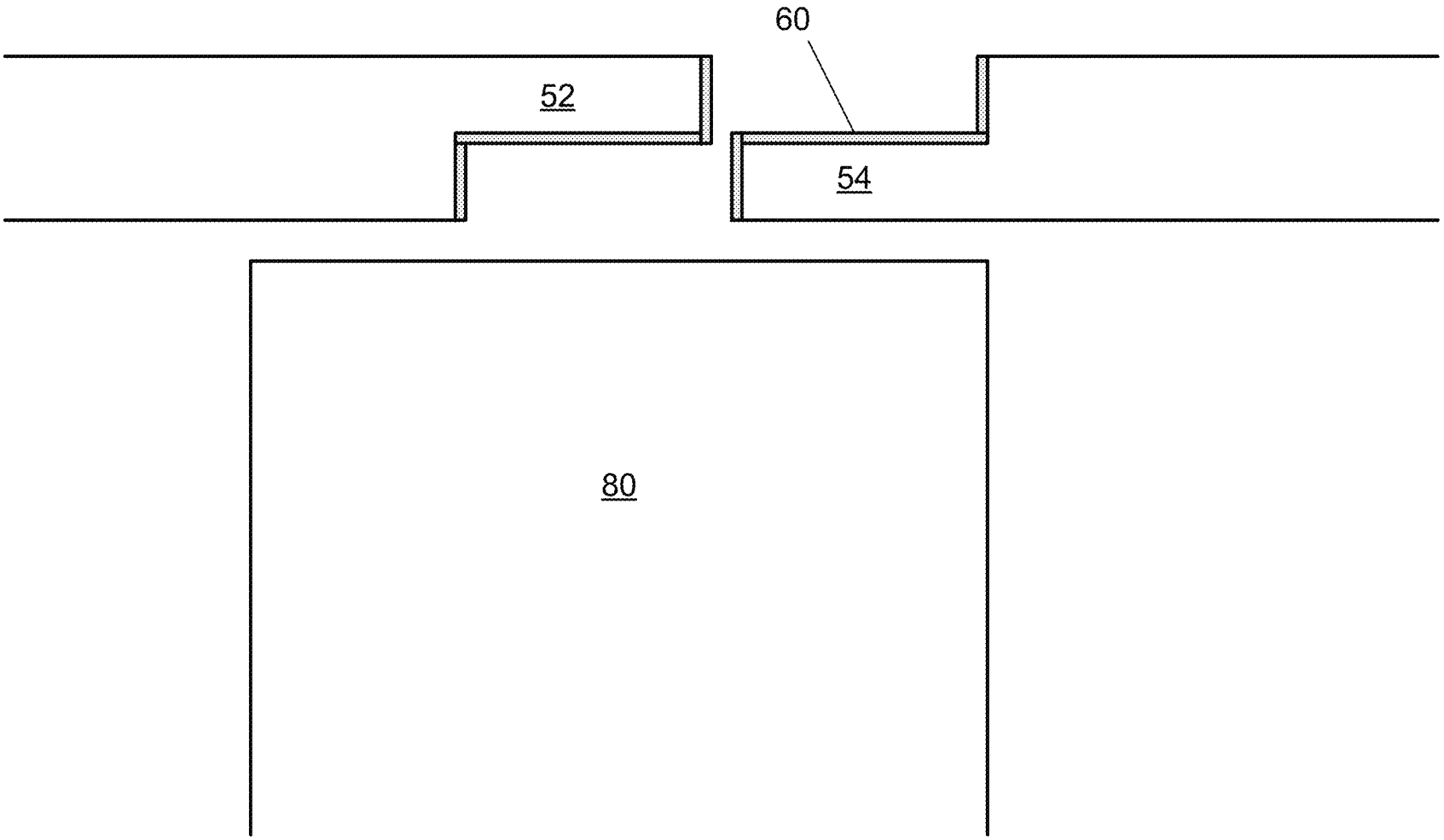
FIG. 4 shows a side view of the components of the shiplap joint.
Figure 5:
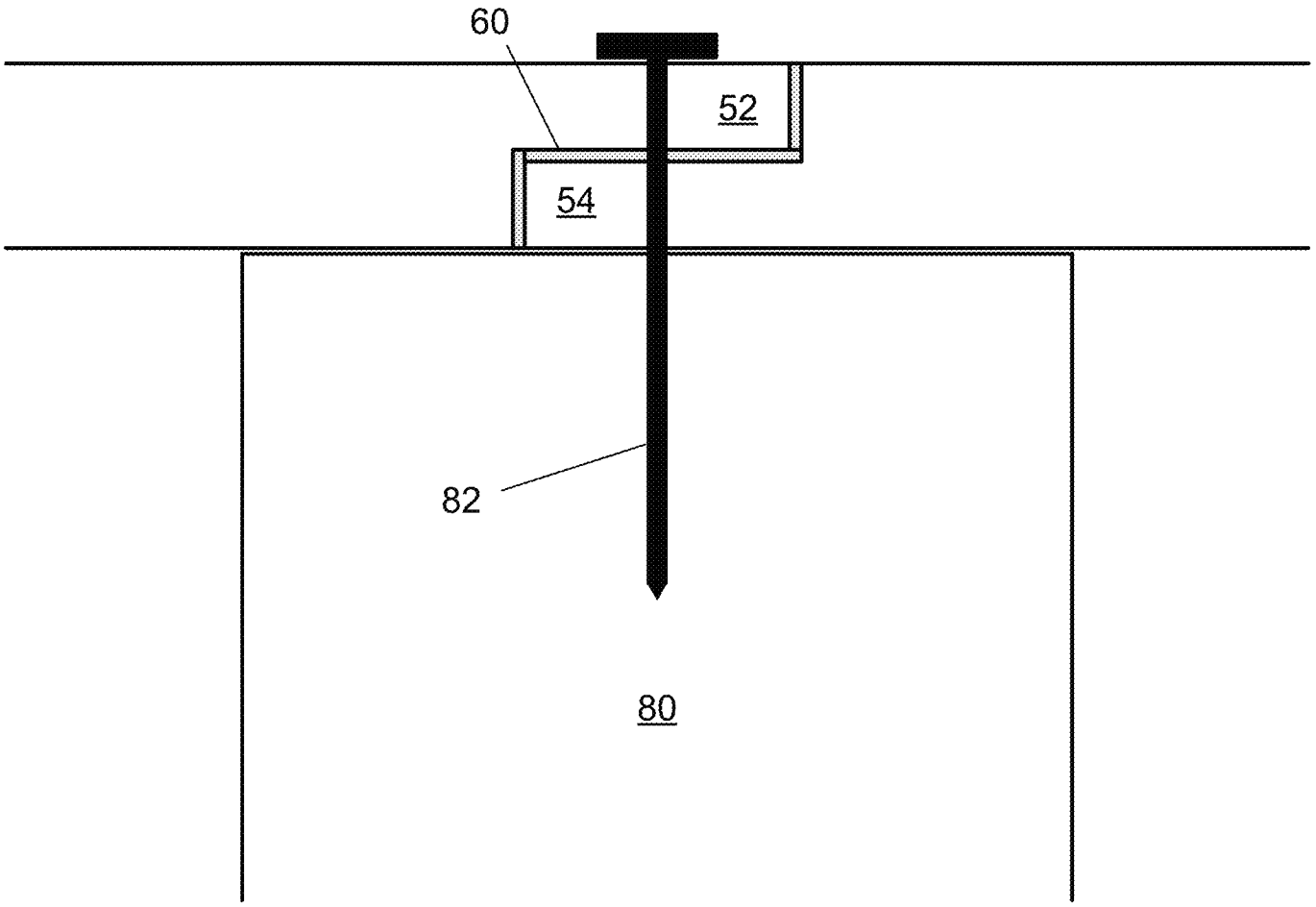
FIG. 5 shows a side view of the formed shiplap joint.

FIGS. 4-5 shows side view profile of embodiments of the shiplap joints. The left side panel comprises the overlap face or side 52 of the shiplap joint, while the right side panel comprises the underlap face or side 54 of the shiplap joint. Gasket material 60 as described above is applied to corresponding faces of the joint. FIG. 5 shows the formed shiplap joint of FIG. 4, being nailed or screwed into place on a wall framing member 80 with a nail or screw 82. When installed, the gasket material on the joints would be touching and form a tight seal with the adjacent panel.

Figure 6:
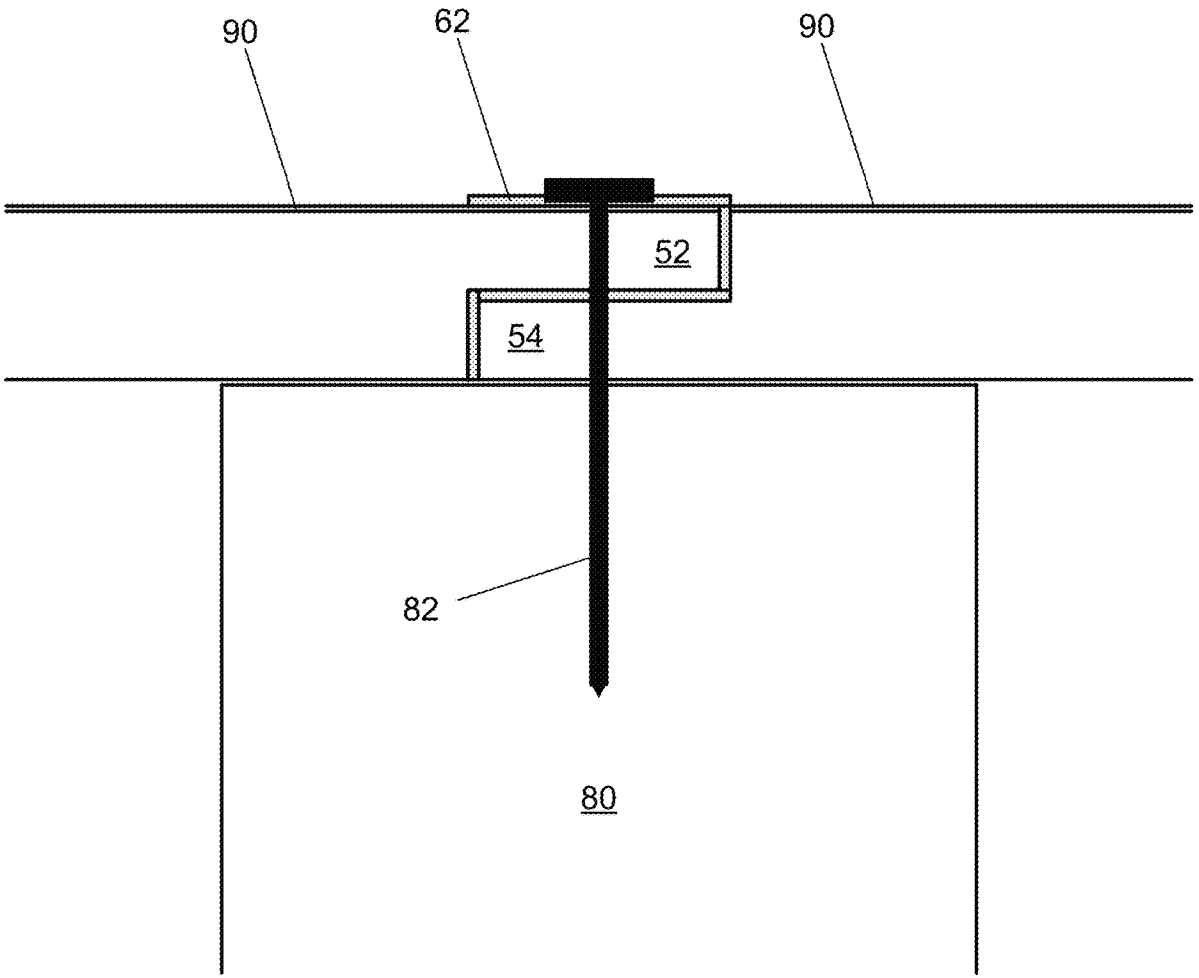
FIG. 6 shows a side view of a formed shiplap joint with WRB overlay.

In several embodiments, the exterior sides of the panels would have a WRB layer or membrane 90 factory applied, as seen in FIG. 6. The gasket material 62 also may be factory applied over or under or contiguous with the WRB layer. This allows the nail or screw head to be sealed when installed.

The present invention provides a number of significant advantages and benefits over the prior art methods of secondary installation of sealing tapes or fluid-applied sealants. First, the elimination of tape or fluid applied sealant results in a significant reduction in both materials, labor, and associated jobsite waste. Second, the overlapping shiplap joint is a reliable method of shedding water from one panel to the next without risk of water entrapment due to the shingle effect of the overlap/underlap joint as water would need to "run uphill" when moving over a horizontal joint. Horizontal joints with the prior art systems are of critical concern as failure in the taped joint may shuttle water into the joint and wall cavity behind. Third, the gasket material applied continuously to the edges of the sheathing shiplap joints will be protected by the sheathing face after installation. Therefore, it will not be impacted negatively by UV degradation and impacts and abrasions common in construction that may damage tapes and sealants applied to the outside of the wall sheathing. Fourth, the gasket material applied to all faces of the shiplap underlap and overlap joints and top face of overlap joint will seal the head and shaft of the fasteners used to install the sheathing panels to the wall framing.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A method of making a self-sealing panel product, comprising:

providing a panel comprising a wood-based material with a front face, a back face, first and second opposing edges, and third and fourth opposing edges;

machining a first joint section in the first edge and the third edge, said first joint section comprising a plurality of faces;

machining a second joint section in the second edge and the fourth edge, said second joint comprises a plurality of faces, wherein the second joint section and the first joint section are configured to mate and form a joint;

bonding, in a factory, a first self-sealing material to and completely covering all faces of said plurality of faces of the first joint sections;

bonding, in a factory, a second self-sealing material to one or more faces of said plurality of faces of the second joint sections;

wherein the first self-sealing material and the second self-sealing material form a water-resistant and air-resistant bond when placed in contact.

2. The method of claim 1, wherein the first joint section is a shiplap joint overlap section and the second joint section comprises a shiplap joint underlap section.

3. The method of claim 1, wherein the first self-sealing material and the second self-sealing material are the same.

4. The method of claim 1, further comprising the step of bonding, at a factory, a portion of the front face adjacent to the first edge and the third edge with a third self-sealing material.

5. The method of claim 4, further wherein the first, second, and third self-sealing materials are the same.

6. The method of claim 1, wherein the first self-sealing material is different from the second self-sealing material.

7. The method of claim 4, further wherein the first self-sealing material is the same as and contiguous with the third self-sealing material.

8. The method of claim 1, wherein the first self-sealing material comprises one or more of rubber, silicone, polyurethane foam, urethane foam, acrylic, polyvinyl acetate, and polyvinyl ester.

9. The method of claim 1, further comprising the step of applying a weather resistive barrier to the front face.

10. The method of claim 4, wherein the third self-sealing material is configured to seal the head and shaft of metal fasteners penetrating through the third self-sealing material.

11. The method of claim 1, wherein said plurality of panels are wall panels.

12. The method of claim 1, wherein said plurality of panels are roofing panels.

13. The method of claim 1, wherein said plurality of panels are sheathing panels.

14. A method of making a self-sealing panel product, comprising:

providing a panel with a front face, a back face, first and second opposing edges, and third and fourth opposing edges;

machining a first joint section in the first edge and the third edge;

machining a second joint section in the second edge and the fourth edge, wherein the second joint section and the first joint section are configured to mate and form a joint;

bonding, in a factory, a first self-sealing material to one or more faces of said plurality of faces of the first joint sections;

bonding, in a factory, a second self-sealing material to one or more faces of the second joint sections;

bonding, at a factory, a portion of the front face adjacent to the first edge and the third edge with a third self-sealing material;

wherein the first self-sealing material and the second self-sealing material form a water-resistant and air-resistant bond when placed in contact; and wherein the first, second, and third self-sealing materials are the same.

15. The method of claim 14, further wherein the first self-sealing material is contiguous with the third self-sealing material.

* * * * *